United States Patent [19]

Luoma

[11] Patent Number: 5,054,648

[45] Date of Patent: Oct. 8, 1991

[54] HIGHWAY CONE DISPENSER AND COLLECTOR

[76] Inventor: Eugene H. Luoma, 1325 Normanna Rd., Duluth, Minn. 55803

[21] Appl. No.: 468,569

[22] Filed: Jan. 23, 1990

[51] Int. Cl.[5] ..... B65G 65/18

[52] U.S. Cl. ..... 221/185; 414/439; 414/507; 404/6; 198/512; 198/518

[58] Field of Search ..... 198/512, 518, 624; 414/437, 439, 440, 507, 529; 221/185; 404/6, 9

[56] References Cited

U.S. PATENT DOCUMENTS

| | | | |
|---|---|---|---|
| 2,632,411 | 3/1953 | Cordes | 198/624 |
| 3,082,908 | 3/1963 | Ingham, Jr. . | |
| 3,096,868 | 7/1963 | Hendrikson et al. | 198/512 |
| 3,124,231 | 3/1964 | Ott | 198/624 |
| 3,157,267 | 11/1964 | Asbury . | |
| 3,232,408 | 2/1966 | Asbury | 198/510 |
| 3,603,479 | 9/1971 | Kuster et al. | 198/624 |
| 4,193,512 | 3/1980 | Buxton et al. . | |
| 4,747,515 | 5/1988 | Kasher et al. . | |
| 4,792,271 | 12/1988 | Akel | 414/440 |
| 4,936,485 | 6/1990 | Downing | 221/185 |

FOREIGN PATENT DOCUMENTS

| | | | |
|---|---|---|---|
| 118757 | 6/1958 | U.S.S.R. | 414/437 |

*Primary Examiner*—Joseph E. Valenza

*Attorney, Agent, or Firm*—Palmatier & Sjoquist

[57] ABSTRACT

A highway marker cone dispenser and collector is provided. A rotatable cone conveyor moves the cones between upper and lower locations, the lower location being near the ground, and has a cone stripper for removing cones from the conveyor at either the upper or lower location. The device may be vehicle mounted for simultaneous rotational and translational movement.

41 Claims, 8 Drawing Sheets

HIGHWAY CONE DISPENSER AND COLLECTOR

The present invention relates to highway construction and maintenance equipment and, in particular, to an implement for depositing and picking up highway markers.

BACKGROUND OF THE INVENTION

Commercial interests, communities and personal freedom may be affected by the condition and number of roads and highways. Thus, it is very important that the maintenance and construction of roads and highways be performed as quickly and efficiently as possible.

Building and maintaining urban roads and highways and the high speed highways linking urban areas present a particular problem, primarily due to the speed and density of traffic. Various pieces of equipment and traffic control methods have been used to improve the speed, efficiency and safety of highway work.

Such equipment may consist of informative signs posted along roadways, portable flashing warning systems or barriers of various kinds which are provided to direct or control the flow of traffic into specific areas or lanes. The last is commonly used and generally may take the form of a series of marking devices such as barrels, either plastic or metal, variously shaped pylons or the typical highway cone-shaped marker.

Generally speaking, these markers, particularly the highway cone, are placed and removed by a number of highway maintenance workers on foot or hanging onto the back of a truck with one hand. The workers involved are exposed to extreme danger because of the speed and density of the traffic. Additionally, the need to rapidly place or remove highway markers or to place such markers over long stretches of highway as on the interstate highway system requires a large number of individual workers.

Prior art somewhat related to these problems and to the general concept of serially depositing or retrieving a plurality of objects includes U.S. Pat. Nos. 3,157,267, 4,193,522 and 4,747,515. U.S. Pat. No. 3,157,267 discloses a roadway signal device retriever; however, the magnetic retriever is for picking up metallic signal devices and does not disclose or suggest a method of depositing the signal devices on a roadway. U.S. Pat. Nos. 4,193,522 and 4,747,515 disclose the concept of dispensing markers or elements serially, but the devices in these patents are not directed to the dispensing and retrieving of highway traffic markers.

SUMMARY OF THE INVENTION

An object of the present invention is to provide a device that can safely, efficiently and inexpensively deposit and retrieve highway markers, particularly highway traffic cones.

Another object of the present invention is to provide a highway cone dispenser and collector that may be mounted on any standard pickup truck without requiring modification of the truck and wherein the device may be efficiently and quickly detached from the vehicle so that the vehicle may be available for other uses.

Yet another object of the present invention is to provide a highway cone collector and dispenser requiring surfaces of generally conical shape to define a tapering annular space between the panels to receive and store the cones. The panels carry flexible fingers to engage and grip the highway cones.

Yet another feature of the present invention is that the cone wheel has an attached in-feed box for efficiently inserting an individual highway cone into the space between the panels for depositing the cone.

Another feature of the present invention is a lower stripping bar for removing a cone from the cone receiving space for deposit on the roadway surface. This stripping bar may be a single bar in a fixed location at the lower periphery of the cone receiving space. Alternatively, the stripping bar may be positionable between a lower location and an upper location for removing the cones from the cone receiving space for deposit and storage, respectively. Also, the invention may be provided with an upper cone stripper in a fixed location for removing the cones for storage and a discrete lower stripping bar in a fixed location for removing the cones for deposit.

Another feature of the present invention is a swing arm and a mounting carriage extending transversely across the width of a vehicle on which the collector and dispenser is mounted so that it may be used on either side of the vehicle. The mounting carriage and the swing arm provide for attaching the dispenser and vehicle on which it is mounted so that it may be used on both sides of the vehicle or stored in the bed of the vehicle.

In operation the highway marker dispenser and collector of the present invention receives a highway cone and then rotates to deposit the highway cone on the highway surface. The in-feed box facilitates the insertion of a cone into the cone wheel near the top thereof for deposit and the lower stripping bar removes the cone from the cone wheel at the bottom of the cone wheel so it will be deposited on the highway surface. For picking up cones a guide aligns cones on the ground with the cone receiving space and as the wheel is translated and rotated the cone is grasped and carried to the top where the operator conveniently may remove it for storage in the box of the pickup truck.

Specifically, for the deposit of highway cones, the operator places a cone in the feed-box and as the cone wheel rotates the cone is gripped in the cone receiving space and carried around the wheel. At the lower portion of the wheel nearest the road surface, the lower stripping bar contacts the upper surface of the base of the cone and strips the cone from the cone receiving space. For the retrieval of cones, the cone wheel is approximately aligned with the row of cones to be picked up. As the collector and dispenser is moved forward, the cone guide aligns the cones with the cone receiving space. As the cones are brought into the cone receiving space they are gripped and rotated to the upper area of the cone wheel where the upper cone stripper removes them from the cone receiving space so the operator conveniently may deposit them in the box of the truck.

It should be appreciated that the cone wheel may be driven by direct contact with the ground or by an ancillary drive wheel or wheels. The present invention can be used to retrieve or deposit highway cones at appropriate, uniform intervals at speeds up to 500 feet per minute without requiring a multiplicity of highway workers or personnel. In addition, the highway cone dispenser and collector is far less dangerous for operators and highway workers because they do not have to place cones while on foot or hanging off vehicles in high speed and high density traffic areas.

A major advantage of the present invention is that it improves the safety conditions for the highway worker.

In addition, the present invention is very efficient, reducing the number of highway construction or maintenance personnel required to distribute and pick up highway markers.

Other advantages of the present invention are that it improves appropriate accurate linear or curvilinear placement of highway marker cones at regular intervals, conforming to highway curves, required lane widths, etc. The cone wheel of the present invention has soft, resilient yet firm gripping surfaces which securely grip and hold the cones yet minimize damage to the reusable soft plastic cones. The present invention provides significant gains in efficiency since the cones may be placed at appropriate, uniform intervals at up to 500 feet per minute. The device may be quickly and easily attached to or detached from standard pickup trucks without requiring modification of the trucks, it may be used on either side of a vehicle and the device may be positioned and locked in a raised position or in the bed of a vehicle for regular travel between operational sites.

Other objects and advantages of the present invention will become more fully apparent and understood with reference to the following specification and to the appended drawings and claims.

BRIEF DESCRIPTION OF THE DRAWING

FIG. 3 is a side elevation view of the cone dispenser and collector of the present invention.

DETAILED DESCRIPTION OF THE PREFERRED EMBODIMENT

Figure 1:
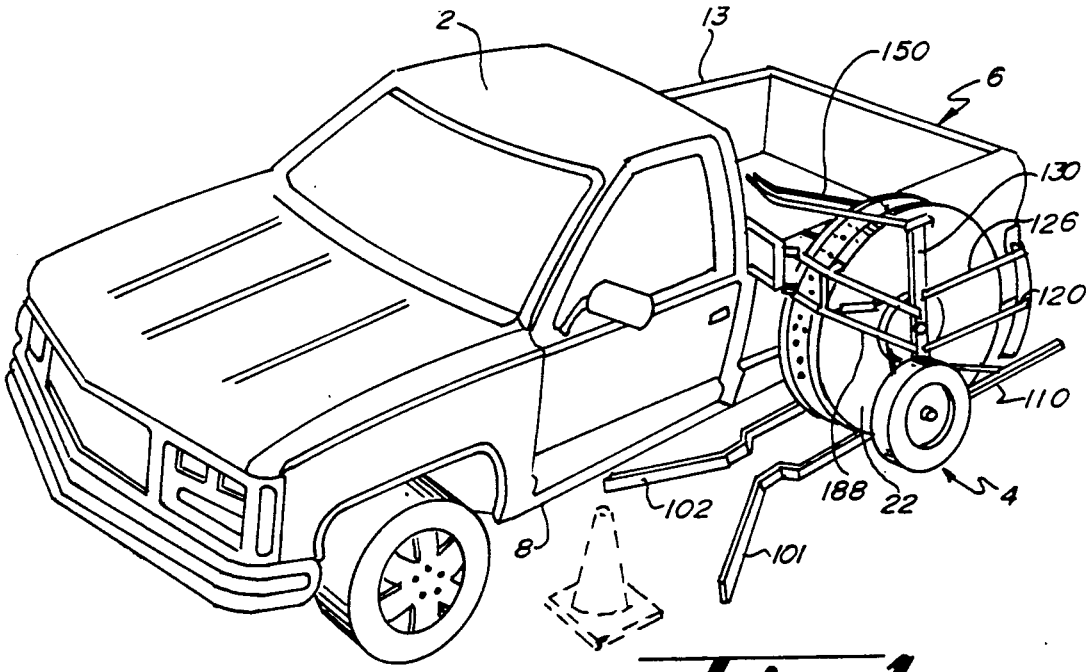
FIG. 1 is a pictorial view of the cone dispenser and collector of the present invention.
Figure 2:
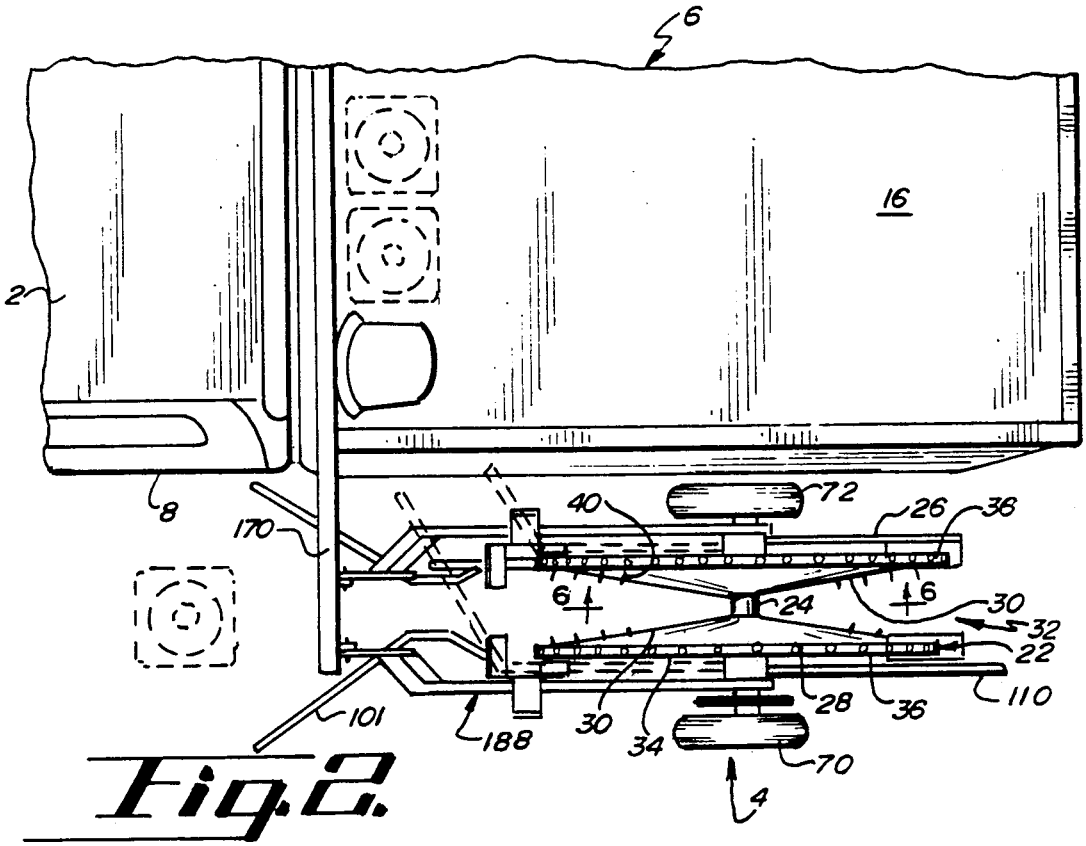
FIG. 2 is a top plan view of the cone dispenser and collector.

A highway cone dispenser and collector is indicated in general by numeral 4 in FIG. 1 and is shown in that figure attached to a truck 2. The cone collector and dispenser 4 is mounted near the bed area 6 of the truck and more specifically is shown mounted on the left or driver's side 8 of truck 2. The rear wheels of the truck are indicated at 12. The truck 2 box 13 provides a cone storage area 16 for receiving typical highway cones, indicated in phantom through-out the figures. A seat 14 may be provided for an operator.

The highway cone dispenser and collector 4, which also may be known as a highway cone conveyor, includes a cone wheel or rotor 22 supported at main hub 24. The cone wheel 22 may be rotatably mounted by a ball bearing and race structure or a journal bearing arrangement. The cone wheel 22 has an inner panel 26 and an outer panel 28. The panels 26, 28 are stiff and may be made from any suitable material, examples are fiberboard, fiberglass or metallic materials such as spun aluminum. The panels 26, 28 have interior grip surfaces. 30 which confront one another and taper convergently toward the main hub 24 to provide a central, tapered cone receiving area 32 between the panels 26, 28. The panels 26, 28 have peripheral rims 34 that do not contact the ground G. Suction cups 36 are located on the rims 34.

Figure 9:
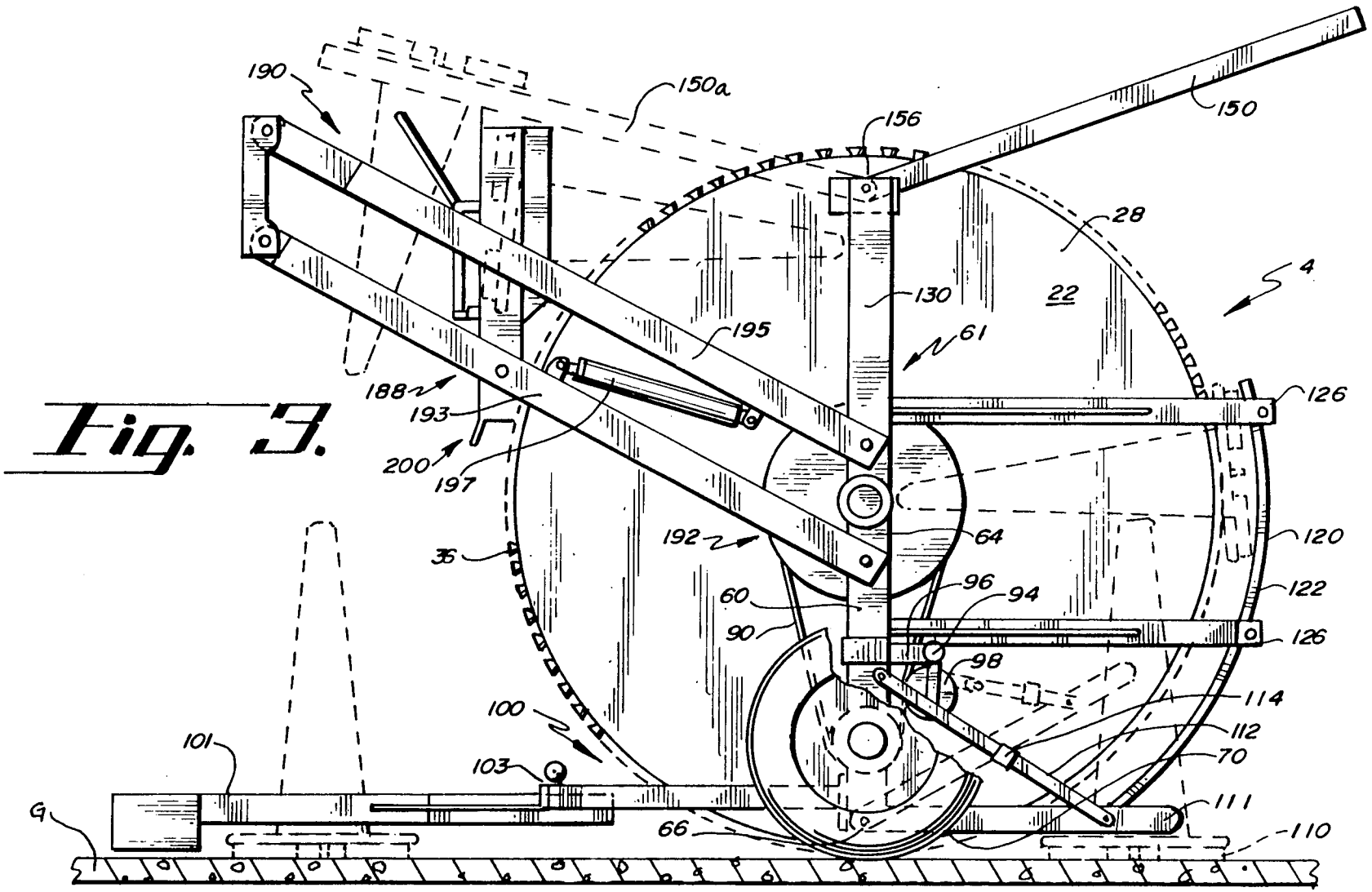
FIG. 9 is a perspective of a modified resilient finger.
Figure 4:
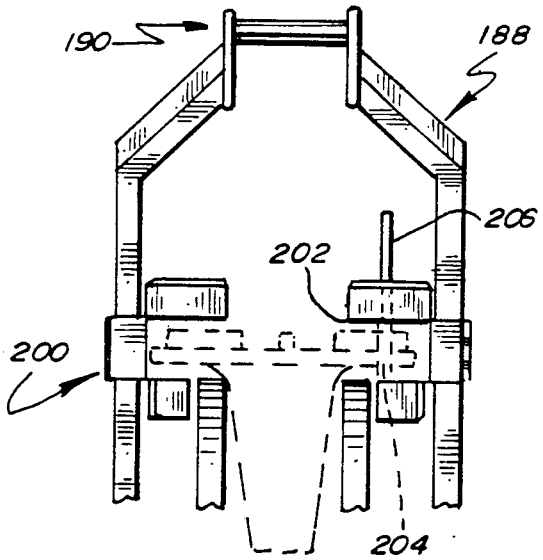
FIG. 4 is a partial top plan view of the present invention showing the feed magazine.
Figure 8:
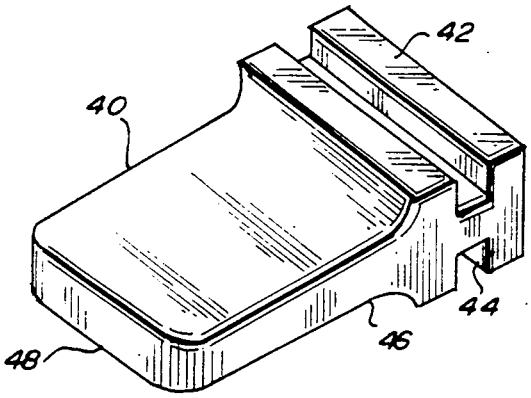
FIG. 8 is a perspective view of a resilient finger.
Figure 6:
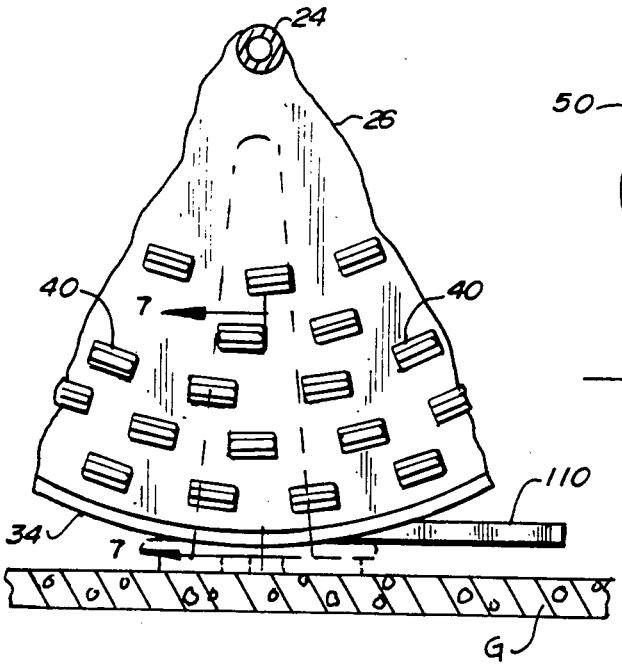
FIG. 6 is a detail section of the cone dispenser and collector at 6—6 of FIG. 2.
Figure 9:
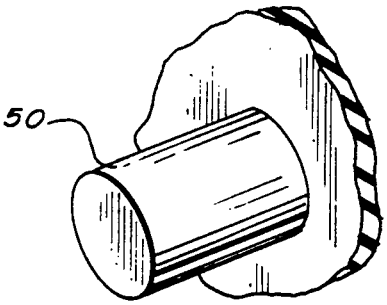
Figure 7:
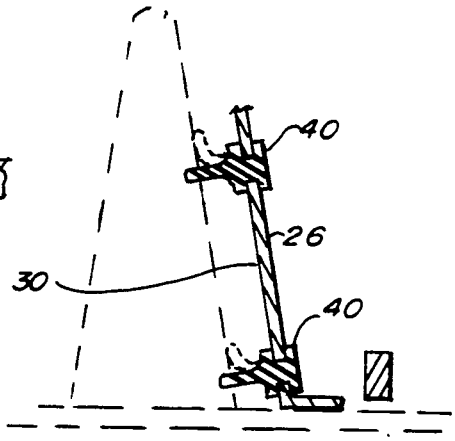
FIG. 7 is a detail section of the cone dispenser and collector taken along lines 7—7 of FIG. 6.
Figure 5:
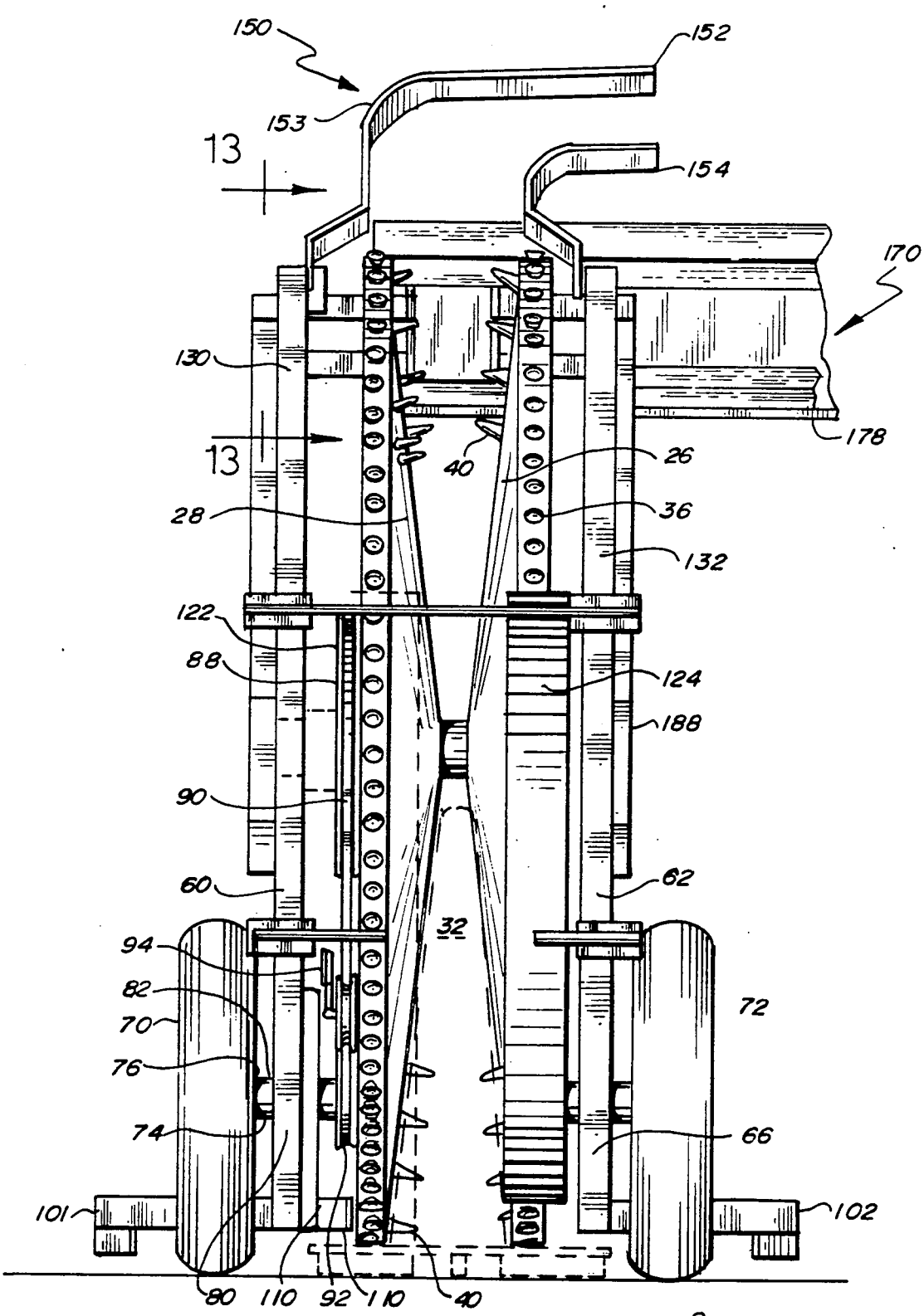
FIG. 5 is a rear elevation view of the cone dispenser and collector.

As shown in the figures, and particularly in FIGS. 8 and 9, the interior grip surfaces 30 of the cone wheel 22 are provided with flexible spatulate fingers 40. The fingers 40 have a base 42 and, near the base 42, a snap fit channel 44 for fitting the fingers 40 to the panels 26, 28 interior grip surfaces 30. Above the channel 44 the fingers have a shank 46 and culminate in flexible tip 48. FIG. 9 shows an alternative embodiment of the resilient flexible fingers 50.

FIGS. 2–5 show further details of the traffic cone collector and dispenser 4 of the present invention including depending columns 60, 62 which are part of the frame 61. Columns 60, 62 have a hub end 64 and a ground end 66. Attached to columns 60, 62 near the ground end 66 thereof collector and dispenser 4 is equipped with a drive wheel 70 and an idler wheel 72. The drive wheel 70 is supported on drive wheel arm 74 having a first end 76 and a distal end 78. A bearing block 80 supports an axle 82 having an outward end 84 and an inner end 86. The idler wheel 72 may be similarly supported and it should be noted that the idler and drive wheels 70, 72 may be mounted on either side of the cone wheel 22.

The mechanical linkage for the drive wheel 70 includes a driven sheave or pulley 88 near hub 24 connected by V-belt 90 to a drive sheave or pulley 92 on axle 82. The cone wheel 22 may be driven by direct contact with the ground, but if the pulley, 88, 92 and belt 90 drive system is used, it should be noted that the pulley size ratio causes the cone wheel 22 to rotate at a speed equal to the linear speed of the hub 24 generated as the truck 2 moves.

The cone conveyor 4 is also provided with a belt tensioner 94. The tensioner 94 is mounted on tensioner post 96 and includes positionable idler pulley 98 mounted on the post 96 to adjustably tension the belt 90.

A forwardly extending in-feed guide 100 is also mounted on depending columns 60, 62. The generally parallel but diverging or curved outwardly arms 101 and 102 making up the guide 100 are partially removable at connection 103. Between the arms 101, 102 and rearwardly toward the cone wheel 22 there is an enlarged space 99. Near connection 103 the arms 101, 102 converge forming a throat 104 before flaring outwardly thereby allowing the base of a cone being deposited to clear the arms 101, 102 through enlarged space 99 as it is rotated downwardly, but also ensuring that the arms 101, 102 ensnare and align cones properly with the cone receiving area 32.

A rearwardly facing retractable highway cone stripper 110 is attached near the ground end 66 of depending columns 60, 62 as well. Either one or both of the columns 60, 62 may have a stripper 110 attached thereto. The stripper 110 comprises a beam or bar 111 which is parallel to the ground and generally tangential to the cone wheel 22. The beam 111 is locked into place and supported in place parallel to the ground by a slidably extensible brace bar 112. Brace bar 112 is extensible through joint 114 which may include a snap or friction lock.

Cones may vary in shape and size. Therefore, as shown in FIG. 3, a curved cone retainer 120 may be fixed to the dependent columns 60, 62. The retainer 120 includes a pair of curved rails 122, 124 supported by retainer support beams 126. The retainer 120 serves to assist in guiding a cone as it is carried around the cone wheel 22.

The figures also indicate that the cone collector dispenser or conveyor 4 of the present invention includes upstanding columns 130, 132. The columns 130 and 132 support an upper cone stripper 150. As shown in FIG. 3, the upper stripper 150 is movable between two positions, one of which is shown in full lines and the other position is shown by dotted lines 150*a*. The stripper 150 is out of the way and nonfunctional when in the full line position and at this time the lower stripper is functional for dispensing cones onto the highway. When stripper 150 is swung to the dotted line functional position, almost tangent to the wheel, the lower stripper bar 111 is retracted upwardly to allow retrieving of the cones The stripper 150 comprises a pair of rails 152, 154 which are pivotable between the two positions shown in FIG. 3. The rails extend from near the upper peripheral rim 34 of the cone wheel 22 and away therefrom and toward the bed area 6 of truck 2 wherein cones may be stored. The curved area 153 is provided so that an operator in the truck 2 bed area 6 may conveniently remove cones from the upper stripper 150 for storage in the bed area 6 of the truck 2. The upper stripper 150 is supported in either position by a support block 156.

The cone conveyor 4 is attached to the truck 2 by a support carriage 170. A flanged frame 172 is provided to support parallel rails 174, 176 which extend across the bed area 6 of truck 2. The support carriage 170 may be secured in place on the bed area 6 by bed brackets 178. A trolley 180 is mounted by two pairs of rollers 182, 184 for transverse movement along the rails 174, 176 across the bed area 6 of the truck.

A pivoting lockable swing arm mount plate 186 is attached to the trolley 180. A swing arm 188 having an upper end 190 and a hub end 192 is attached to plate 186 and near the main hub 24. The arm 188 is fork or yoke shaped being affixed to the upstanding and depending columns, 130, 132 and 60, 62 respectively, on both sides of the cone wheel 22. The arm has two parallel beams 193, 195 on each side and between the beams 193, 195 hydraulic cylinders 197, 199 are mounted. The cylinders 197, 199 are provided to raise and lower the dispenser and collector 4 into various operational positions. The cylinders 197, 199 may be connected to a conventional source of hydraulic or pneumatic pressure.

The swing arm 188 may also support a cone feeder 200. The feeder 200 includes an open cone magazine 202 having a cone holding pin 204 and a release lever 206. The feeder 200 is generally tangent to the cone wheel 22 and is open at its upper side so an operator may drop a cone therein.

The trolley 180 is provided with a releasable lock 208 for affixing the cone conveyor 4 in a specific location relative to the truck 2 on which it is mounted. The lock 208 includes a friction plate 210, attached to the trolley 180, which is put into locking frictional contact with the rail 176 by a tightening screw 212 driven by hand knob 214. The operation of the support carriage 170 to position the cone collector and dispenser 4 of the present invention will be explained herein below.

Figure 10:
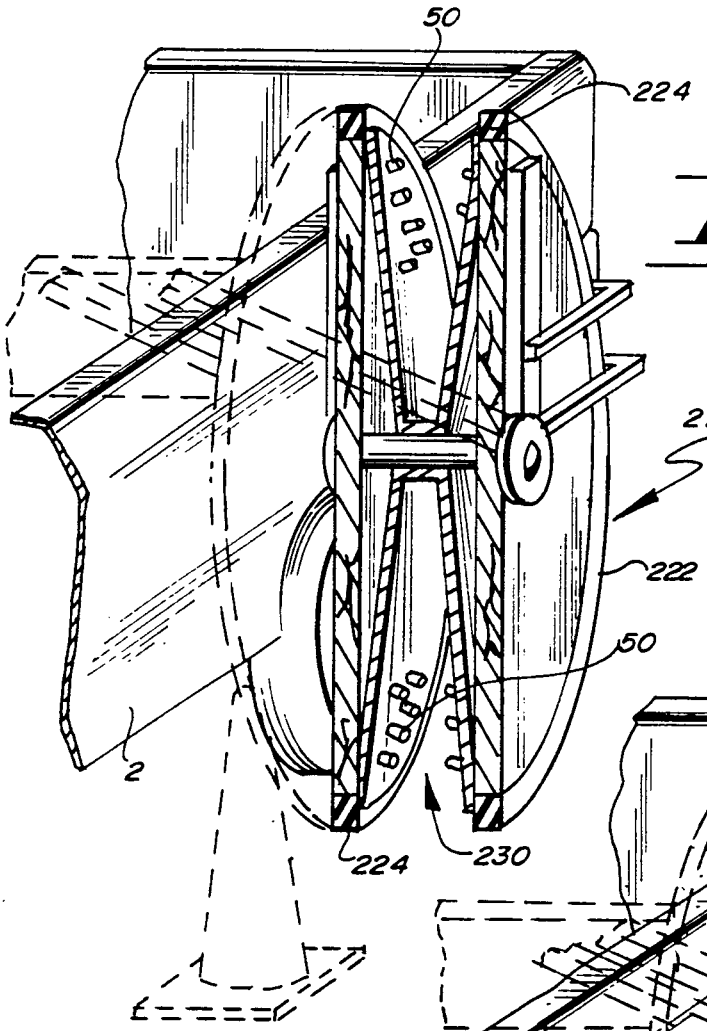
FIG. 10 is a perspective view, partially in section, of an alternative embodiment of the cone wheel of the present invention.
Figure 11:
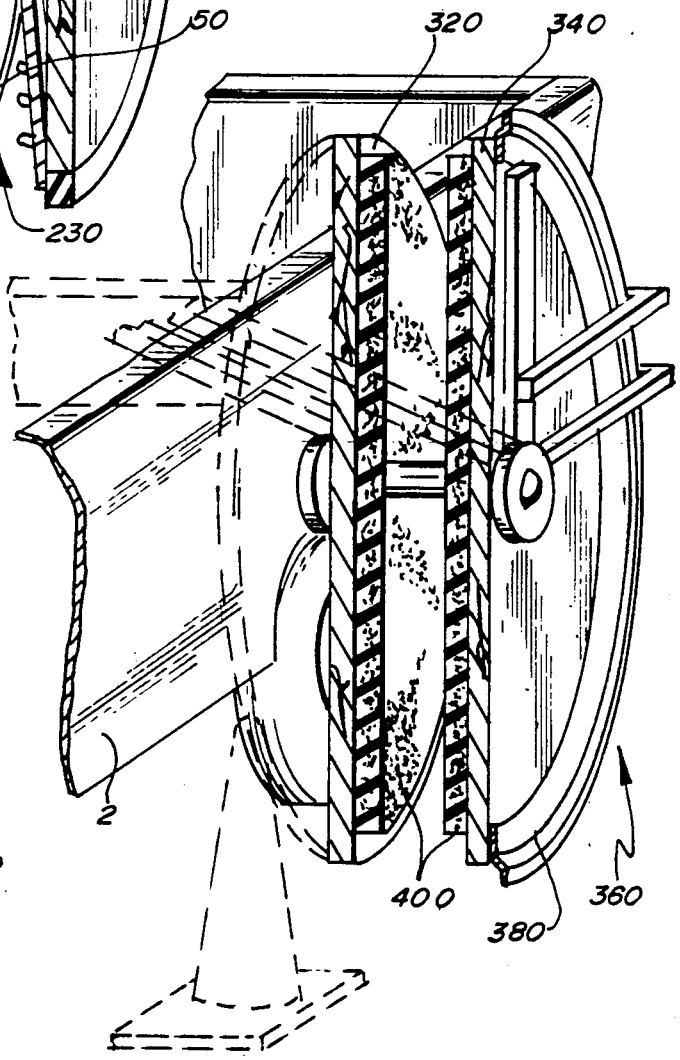
FIG. 11 is a perspective view, partially in section, of another alternate embodiment of the cone wheel of the present invention.
Figure 12:
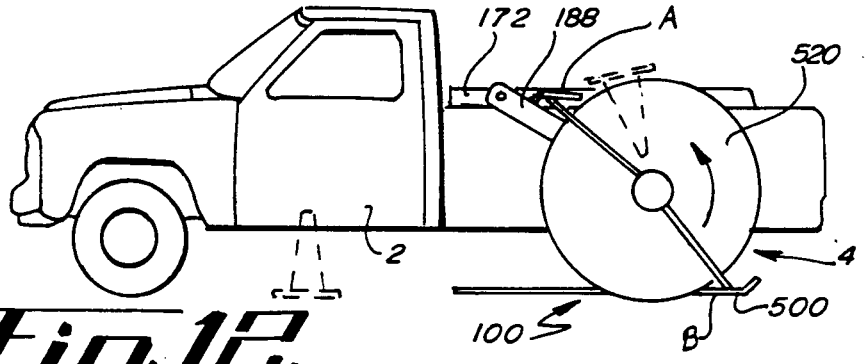
FIG. 12 is a largely schematic side elevation of a modified form of the cone dispenser and collector.

FIGS. 10 through 12 depict alternative embodiments of the present invention. Specifically, FIG. 10 shows a cone wheel 220 having rims 222 with a rubber wear surface 224 attached thereto. The rubber wear surface 224 makes direct contact with the ground thereby providing the drive power to rotate the cone wheel 220.

The cone wheel 220 (or 22) of the present invention may be comprised of various suitable materials as shown in FIG. 10 wherein the cone wheel 220 is made from plywood and sheet metal. Also, the alternative embodiment of the resilient fingers 50 shown in FIG. 9 are shown in FIG. 10 as they may be disposed in the interior grip area 230 of the cone wheel 220.

FIG. 11 shows an embodiment wherein one of the inner or outer panels 320, 340 making up the cone wheel 360 may be provided with a steel ground contacting drive and wear rim 380. The wear rim may be integrated with or attached to either the inner or outer panel, 320, 340 respectively. FIG. 11 also shows that resilient fingers in the grip area may be replaced with a soft resilient pad 400.

The modified form of the present invention shown in FIG. 12 discloses a stripper 500 which is selectively movable or positionable between an upper position indicated at A and a lower position indicated at B in that figure. In position A, the stripper 500 facilitates the removal of a typical cone from the upper area of the cone wheel 520, and in position B, the stripper 500 provides for the removal of the cone from the cone wheel 520 for deposition on the ground.

Figure 13:
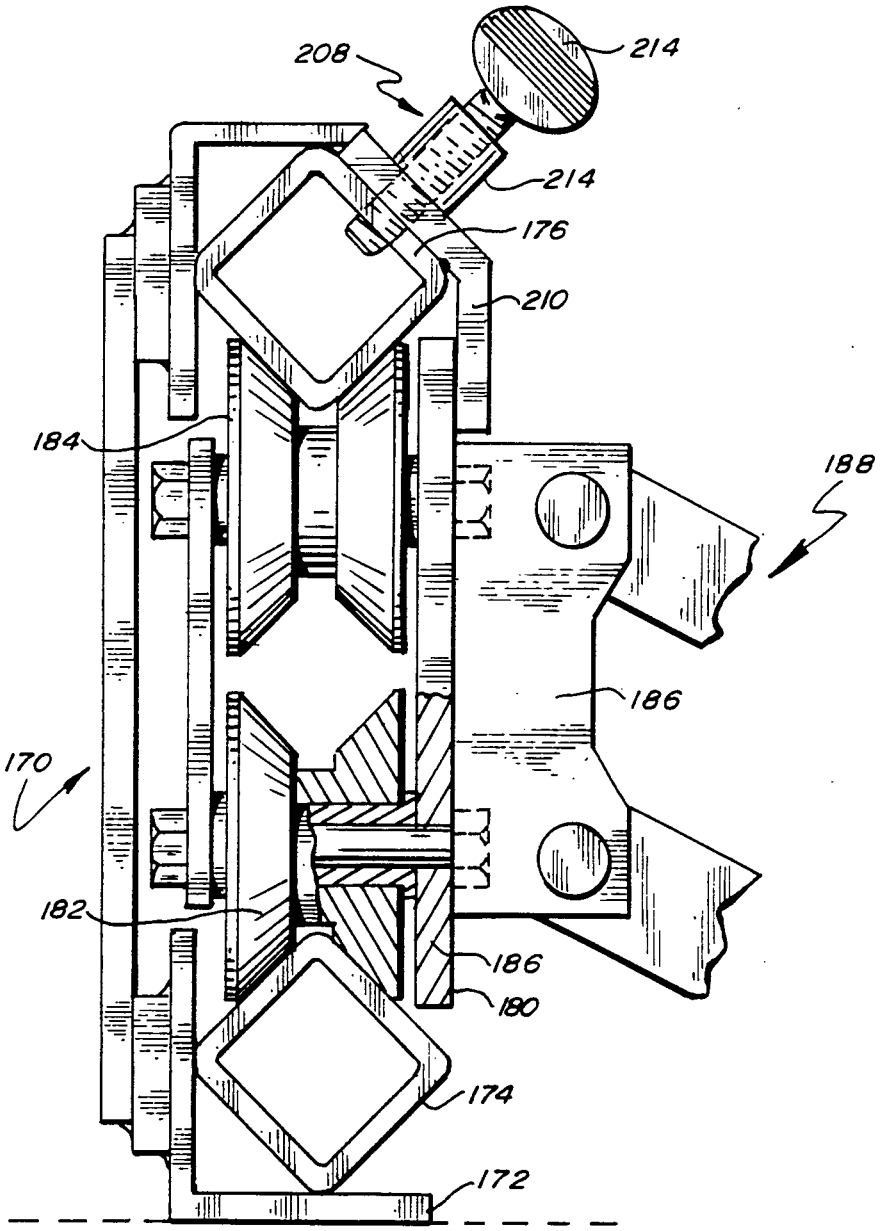
FIG. 13 is a cross sectional view of the mounting carriage for the dispenser and collector of the present invention taken along lines 13—13 of FIG. 5.

FIG. 13 is a cross section of the support carriage 170 of the present invention and is provided to show additional detail of that feature, specifically, the trolley 180, rollers 182, and rails 174, 176 of the mounting carriage 170.

Figure 16:
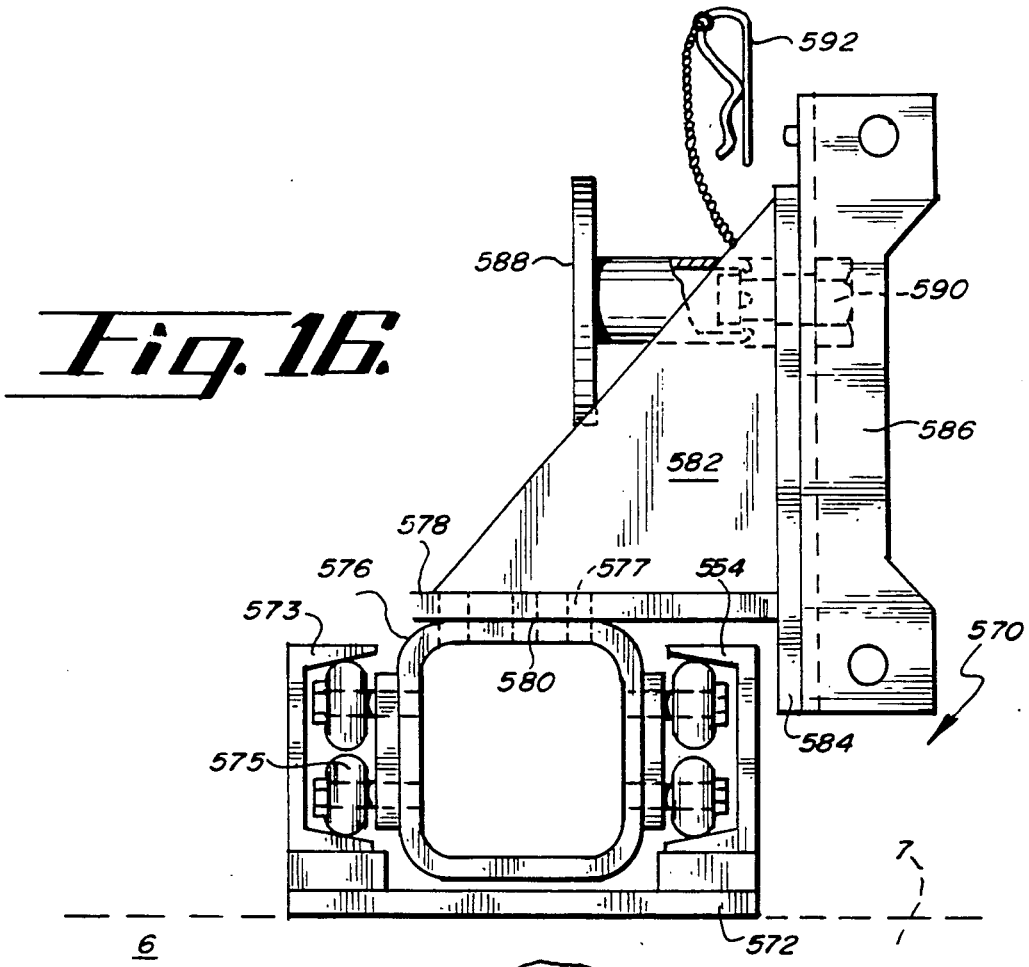
FIG. 16 is a side elevation view, partially in section along line 16—16 in FIG. 15, showing the modified form of the mounting carriage shown in FIG. 16.
Figure 15:
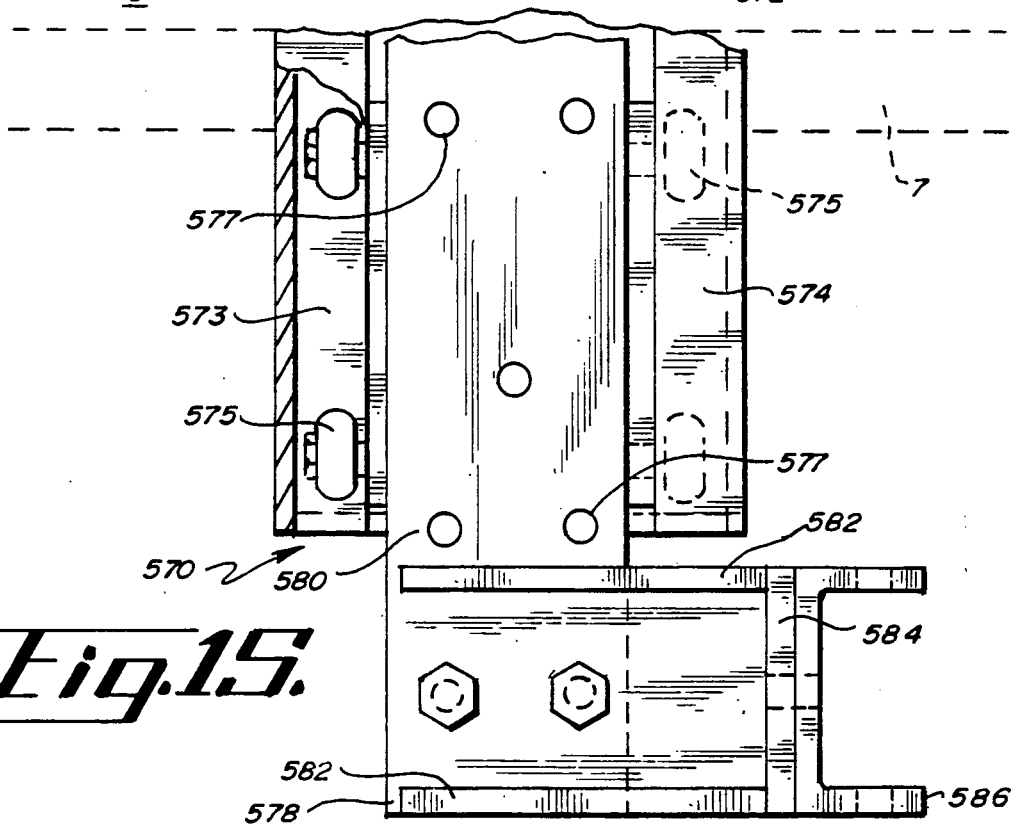
FIG. 15 is a top plan view of part of a modified form of the mounting carriage for the dispenser and collector of the present invention.

FIGS. 15 and 16 show a modified form of the support carriage 570 for use with the present invention. A cross frame track 572 having two parallel, U-shaped rails 573, 574 extends transversely across the width of the bed area 6 of a truck. As shown in FIG. 16, the track 572 may extend beyond the sides 7 of the bed area 6. The track 572 captures and guides a plurality of rollers 575 mounted on a trolley tube 576, whereby the tube 576 may travel along the length of the track 572. The tube may be provided with a conventional screw-tightened friction lock or may be releasably fastened by a removable pin in a selected location along the track 572.

A trolley extension 578 is attached at a selected location to the upper side 580 of the trolley tube 576. The location may be varied by using the provided apertures 577. The extension 578 may be integral with or welded, bolted or other otherwise attached to the tube 576 and is buttressed by triangular webs 582. The extension 578 provides mounting flange 584 for receiving a collector and dispenser 4 frame arm 188 mounting plate 586. Plate 586 may be secured by a handle 588 actuated lock pin 590. Pin 590 may be held in the locked position by a cotter key or pin 592.

For dispensing cones onto the highway, the cone collector and dispenser 4 may be positioned as shown in FIG. 1. An operator in the bed area 6 of truck 2 has access to highway cones stored in the bed area 6. The upper cone stripper 150 is positioned in the full line position as shown in FIG. 3 and the bottom stripper 110 is lowered until it is parallel to the ground to protrude outwardly of the periphery of the wheel. The driver of the vehicle proceeds forward along the line on which cones are to be distributed at intervals. The operator in the bed area 6 of the truck 2 places a series of cones, one at a time, into the feeder 200. As the vehicle 2 moves along the highway the drive wheel 70 revolves and causes the cone wheel 22 to rotate; and the periphery of the wheel has a linear speed very nearly the same as the speed of the vehicle traveling along the highway. The cone will be gripped in the cone receiving area 32 and carried toward the ground as the cone wheel 22 rotates. As the cone approaches the pavement or ground, the base of the cone passes through the enlarged space 99, between the guides 101, 102 and rearwardly of the narrow throat 104 between the guides. When the cone reaches the ground and the bottom area of the cone wheel 22, the cone base comes to rest upon the pavement and the upper side of the cone base is contacted by the cone stripper 110. As the wheel 22 continues to rotate, the stripper 110 holds the cone in contact with the pavement as the wheel tends to lift the cone. The cone is thereby stripped from the cone receiving area 32 of the wheel 22, and is left standing on the highway as the truck travels on. In the meantime the operator in the bed area 6 may have inserted an additional cone or cones which will also be deposited at regular intervals along the pavement. The intervals between deposited cones may be varied by the frequency at which the operator inserts the cones and a signal device, either visual or audible, may be provided to cue the operator to achieve proper intervals between the deposited cones.

For collecting a line of cones already on the highway, the bottom stripper 110 is retracted or pivotally elevated to the position shown in phantom lines in FIG. 3 and the upper stripper 150 is moved into its forwardly extending operative position, shown at 150*a* in FIG. 3. The driver of the truck 2 approximately aligns the cone collector 4 with the row of cones and drives forwardly whereby the ground contacting drive wheel 70 causes the cone wheel 22 to rotate. The cones on the ground will be guided toward the cone receiving area 32 by the in-feed guide 100 and the wheel and receiving area thereof will roll onto the stationary cone. As the cone enters the receiving area 32 the soft body of the cone will be gripped by the fingers 40 and be rotated upwardly as the wheel 22 revolves. Depending upon the size of the cone and its base, the base will be held by suction cups 36, but also may be guided in its upward travel by the cone retainer 120. When the cone reaches the upper portion of the wheel's orbit, the cone base contacts the upper stripper 150 and the cone is drawn out of the receiving area 32 and will slide along stripper bars 152, 154 so that the operator may grab the cone and place it in the bed area 6 for storage.

Figure 14:
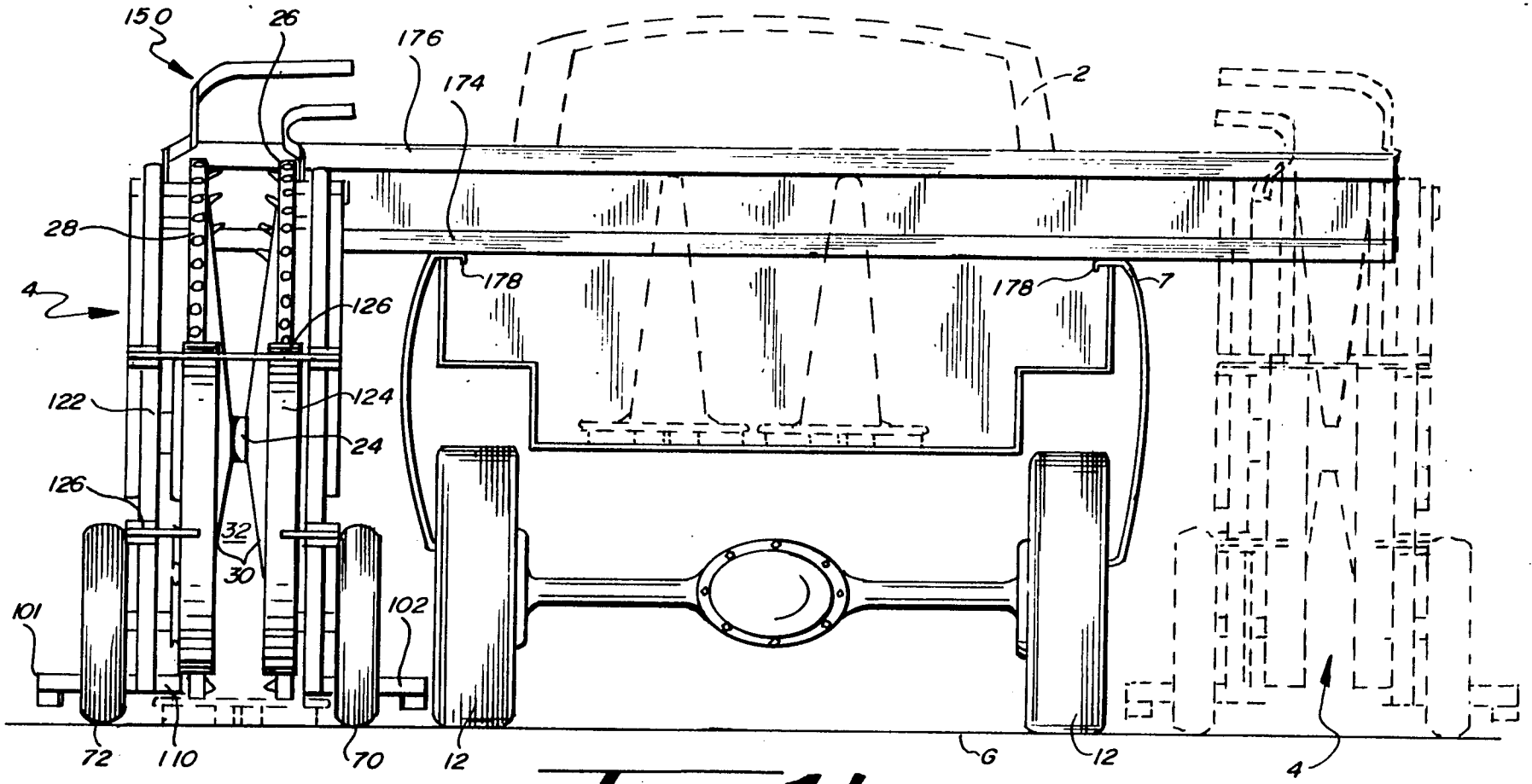
FIG. 14 is a rear elevation view, partially in phantom, showing the present invention as it may be mounted on a vehicle.

In use the cone collector and dispenser 4 of the present invention may be mounted on a vehicle 2 as shown in FIG. 1. It should be appreciated that the support carriage 170 and frame 172 adapt the cone dispenser and collector 4 for use with any standard pick-up truck, as well as other vehicles. Because rails 174, 176 extend across the width of the truck 2, the dispenser and collector 4 may be used on either side of the truck. To move the dispenser and collector 4, the cylinders 197, 199 are activated to raise the cone wheel. The pivoting swing arm plate 186 attached to the trolley 180 is unlocked and the cone wheel may be moved to a horizontal position relative to the ground and above the bed area 6. The trolley 180 can then be moved along rails 174, 176 until the cone wheel 22 may be moved into vertical position on the other side of the truck 2 by pivoting the plate 186, which is then locked in place. The cone wheel 22 then may be lowered by cylinders 197, 199 into its operational position shown in phantom in FIG. 14. It should be recognized that the support carriage 170 also enables the collector and dispenser 4 to be placed in the bed area 6 of the truck 2 for transport or storage. The modified form support carriage 570 is operationally similar to support carriage 170.

The modified forms of the present invention shown in FIGS. 10, 11 and 12 are operationally similar, but the cone wheel shown therein is rotated on the ground as the truck moves along. In FIG. 12, for deposit of cones, the stripper 500 is moved to position B and for retrieval of cones, it is placed in position A.

The highway cone collector and dispenser 4 of the present invention may take different forms within the scope of the invention. In certain embodiments it may be fixedly mounted on either side of a truck; it may be an implement which is not vehicle mounted but rather is operator driven by an operator on foot; the panels 26, 28 comprising the cone wheel 22 may take various other configurations, for example, polygonal. Additionally, the collector and dispenser 4 may be provided with warning beacons to alert traffic to its presence.

It will be seen that I have provided an new and improved highway traffic cone collector and dispenser 4 which provides a very cost effective, efficient and safe method of collecting and dispensing highway cones in high speed and high density traffic areas.

Additionally, my invention may be easily installed on any standard pickup truck type vehicle.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. An apparatus for delivering highway markers with base plates between upper and lower locations and dispensing the markers at one of such locations, comprising:

a marker conveying means having upper and lower portions and conveying the markers therebetween, said means comprising marker gripping means and further comprising dispensing means adjacent one of said portions, said dispensing means comprising base plate engaging portions for loosening the markers for removal from the conveying means.

2. The apparatus of claim 1, wherein said conveying means comprises a pair of spaced portions mounted on a common central axis for uniform rotation with respect to each other, said portions having resilient gripping means therebetween for releasably grasping and holding markers, whereby when said gripping means grasps and holds a marker and the conveying means is subsequently rotated, the marker may be moved from a lower location to an upper location or from an upper location to a lower location.

3. The apparatus of claim 1, wherein the conveying means has an upper periphery and a lower periphery, and wherein said dispensing means for removing a marker from the gripping means may be selectively rendered operable and inoperable at either the upper or lower periphery of the conveying means.

4. The apparatus according to claim 2, wherein the conveying means is a rotary device and said spaced portions comprise peripheral portions, said base plate engaging portions comprising a stationary bar adjacent the peripheral portion of at least one of the spaced portions and spaced from the gripping means, the bar diverging from the peripheral portion and away from the axis to engage the base plate of a marker for urging the marker out of said gripping means.

5. An apparatus for delivering highway markers with base plates between upper and lower locations and dispensing the markers at one of such location, comprising:

a marker conveying means having upper and lower portions and conveying the markers therebetween, said means comprising marker gripping means and further comprising dispensing means adjacent one of said portions for loosening the markers for removal from the conveying means, and the dispensing means comprises a stationary bar provided adjacent the lower portion of the marker conveying means to engage the base plate of a marker for urging the marker out of the gripping means.

6. The apparatus of claim 1, wherein said gripping means comprises a plurality of flexible fingers having a free end and a base, the base being affixed to the marker conveying means, the free end for frictionally contacting a marker being conveyed by the conveying means.

7. The apparatus of claim 2, wherein said gripping means comprises a plurality of flexible fingers having a free end and a base, the base being affixed to the inwardly facing surfaces of said spaced portions, the free end for frictionally contacting a marker entering the space between the spaced panels.

8. The apparatus of claim 2, wherein said resilient gripping means comprises a resilient pad affixed to the inwardly facing surfaces of said spaced panels.

9. A rotary device for delivering soft bodied highway markers with bodies and base plates between upper and lower locations, comprising:

a pair of stiff upright panels confronting each other and having peripheral portions cooperatively defining marker body receiving spaces generally tapering from said peripheral portions convergently toward a central rotation axis about which the panels revolve; and marker gripping means on a portion of at least one of the panels and adjacent said spaces.

10. A rotary device according to claim 9, wherein a stationary bar is provided adjacent the peripheral portion of one of the panels and spaced from the marker body receiving space, the bar diverging from the peripheral portion and away from the axis to engage the base plate of a marker for urging the marker out of said space.

11. The rotary device according to claim 10 and said stationary bar being retractable to a position inwardly of the peripheral portions of the panels to be inoperative for engaging the marker base plates.

12. The rotary device according to claim 10 and a second stationary bar, said stationary bars being respectively disposed adjacent upper and lower peripheral portions of said panels, one of said stationary bars being movable away from the adjacent peripheral portions of the panels to be inoperative for engaging the marker base plates.

13. The rotary device according to claim 9 and guide means selectively operable for guiding such markers into the panels at selected lower ground level and upper elevated locations, and marker stripping means selectively operable for removing such markers from the panels at selected lower ground level and upper elevated locations, whereby to place and retrieve such markers on and from the ground.

14. A highway marker conveying means for use with a vehicle in dispensing highway marker cones with base plates, said conveying means comprising:

a cone conveying wheel with cone gripping means and including spaced gripping portions between which the cones are gripped;

a means for mounting the cone conveying wheel on a vehicle to permit the cone wheel to revolve along the ground; and a stripping means adjacent a portion of the cone wheel for engaging the base plate of a cone carried by the wheel and guiding a cone out of the space between the gripping portions.

15. The conveying means of claim 14, wherein the cone conveying wheel has an upper peripheral portion and a lower peripheral portion, said stripping means being positioned adjacent the upper peripheral portion of the cone wheel.

16. The conveying means of claim 14, wherein the cone wheel has an upper peripheral portion and a lower peripheral portion, said stripping means being positioned adjacent the lower peripheral portion of the cone wheel.

17. The conveying means of claim 14, wherein the cone wheel has upper and lower peripheral portions, and said stripping means being located adjacent both upper and lower peripheral portions of the cone wheel, and said stripping means being adapted to be selectively rendered inoperative at both the upper and lower portions of the wheel.

18. A mobile highway marker conveying means for setting out and retrieving highway marker cones, said conveying means comprising:

a cone conveying wheel to revolve adjacent the highway and comprising spaced portions confronting each other and wherein the space between the portions is a cone receiving space;

a feed means for inserting a cone into the cone receiving space; and a stripping means for removing a cone from the cone receiving space.

19. The conveying means of claim 18, wherein the cone conveying wheel has an upper peripheral area and a lower peripheral area, said stripping means being positioned adjacent the upper peripheral area of the cone wheel.

20. The conveying means of claim 18, wherein the cone wheel has an upper peripheral area and a lower peripheral area, and wherein the stripping means may be selectively moved to a predetermined fixed position near either the upper peripheral area or the lower peripheral area.

21. A vehicle mounted implement for serially depositing and picking up highway traffic cones, said implement comprising:

a rotatable cone conveying means having stripping means for stripping cones from the conveying means at a selected location and guide means for aligning and retaining cones relative to the conveying means;

and a mounting means for attaching the implement to a vehicle comprising a track means extending across the width of the vehicle, a carriage movably mounted thereon and an arm attached between the carriage and the conveying means whereby the conveying means may be raised and lowered with respect to the ground and may be moved laterally relative to the sides of the vehicle.

22. The implement of claim 21, having a drive means comprising a ground contacting drive wheel mechanically linked to the conveying means.

23. The implement of claim 21, wherein the conveying means comprises a cone conveying wheel having an outer periphery, said outer periphery contacting the ground and thereby comprising said drive means.

24. The implement of claim 21, wherein the conveying means is annular having an outer periphery and a hub, and wherein said drive means drives the outer periphery at a rotational speed equal to the translational speed of the hub generated as the vehicle moves linearly.

25. A vehicle mounted apparatus for distributing and retrieving highway traffic cones having a base and a conical body, said apparatus comprising:

a metallic generally tubular support frame having a pair of spaced upstanding frame columns having an upper end and a lower end, said columns supporting a hub approximately midway between said upper and lower ends of the columns and extending therebetween;

a cone wheel rotatably mounted on said hub between the columns, said cone wheel comprising a pair of spaced generally parallel upstanding annular panels having confronting surfaces of generally conical shape defining a tapering annular cone receiving space between the panels for receiving cones, said panels having an annular outer periphery and mounted on a common central axis of rotation on said hub, said cone receiving space tapering inwardly from said periphery to said hub;

a plurality of flexible fingers attached to the confronting surfaces of the panels in the cone receiving space to engage and grip cones entering the space;

a mounting means for attaching said apparatus to a vehicle and for supporting the frame and cone wheel, said mounting means comprising a plurality of vehicle brackets attached to the vehicle, a pair of parallel rails extending transversely across the vehicle and supported by said brackets, a trolley slidably mounted on said rails for movement along the length thereof across the entire width of the vehicle and a swinging arm connected to and extending between the trolley and the frame columns, said arm pivotally connected to the trolley and having a cone in-feed magazine attached thereto adjacent said periphery of the cone wheel, whereby the cone wheel may be raised or lowered relative to the ground and moved transversely relative to the vehicle;

at least one lower retractable stripping bar attached to the lower end of at least one of the frame columns, said stripping bar being adjacent the periphery of the cone wheel and spaced from the cone receiving space, the bar diverging from the periphery and away from the hub to engage the base of a cone to force the cone out of the cone receiving space;

an upper cone stripper attached to the upper end of at least one of the frame columns, said upper stripper comprising a pair of generally parallel curved rails, said rails having a first end and a second end, the first end being adjacent to the periphery of the cone wheel and said rails diverging from the periphery and away from the hub toward the second end, said stripper being pivotally mounted on the frame columns whereby said rails may be moved from a generally forwardly extending position to a generally rearwardly extending position relative to the vehicle on which the apparatus is mounted; and at least one drive wheel for driving the rotation of the cone wheel, said drive wheel attached to the lower end of at least one of the frame columns, said drive wheel fixed on an axle on which is also mounted a drive pulley operatively connected by a continuous drive belt to a driven pulley fixedly mounted on and connected to said cone wheel at said hub, said drive wheel contacting the ground when the cone wheel is lowered for operation whereby the translational movement of the vehicle is transformed into rotary motion of the cone wheel, said rotary motion having a speed equal to the translational speed of the hub.

26. The apparatus of claim 25, wherein said annular outer periphery has a plurality of discrete suction cups mounted continuously and equidistantly there around for contacting the base of the cones.

27. The apparatus of claim 25, wherein said mounting carriage includes at least one hydraulic cylinder attached to said swinging arm.

28. The apparatus of claim 25, wherein said cone wheel periphery contacts the ground when the cone wheel is lowered into operational position thereby causing the cone wheel to rotate as the vehicle is moved.

29. A method of delivering highway markers with bases from the elevated bed of a moving vehicle to the highway surface, comprising the steps of:

conveying the marker down to the highway surface and orienting the marker with its base confronting the highway surface, engaging and guiding the base of the marker to lie upon the highway surface, and releasing the marker and its base.

30. The apparatus according to claim 4, wherein said spaced portions comprise upper and lower peripheral portions, said bar being disposed adjacent said upper peripheral portion.

31. The apparatus according to claim 4, wherein said spaced portions comprise upper and lower peripheral portions, said bar being disposed adjacent said lower peripheral portion.

32. A highway marker conveying means according to claim 14 wherein the cone conveying wheel engages and rolls along the highway.

33. A highway marker conveying means according to claim 14 wherein the cone conveying wheel is spaced above the highway, and a drive wheel rolling on the highway and revolving said cone conveying wheel.

34. A mobile highway marker conveying means according to claim 18, wherein said cone conveying wheel has an upper peripheral area and a lower peripheral area, said stripping means being positioned adjacent said lower peripheral area.

35. A mobile highway marker conveying means according to claim 18, wherein the cone conveying wheel has an upper peripheral area and a lower peripheral area, said feed means being positioned adjacent the upper peripheral area.

36. A mobile highway marker conveying means according to claim 18, wherein the cone conveying wheel has an upper peripheral area and a lower peripheral area, said feed means being positioned adjacent said lower peripheral area.

37. A rotary device for delivering soft bodied highway markers with bodies and base plates between upper and lower locations, comprising:

a pair of stiff upright rotor portions confronting each other and having peripheral portions cooperatively defining marker receiving spaces generally tapering from said peripheral portions convergently toward a central rotation axis about which the rotor portions revolve; and marker gripping means on a portion of at least one of said rotor portions and adjacent said spacers.

38. A mobile apparatus to travel along a highway for handling highway markers with base plates, comprising:

a marker conveying means comprising upper and lower portions between which such markers may be conveyed, and a stripper portion adjacent one of said upper and lower portions for removing the highway markers from the conveying means, and a guide portion adjacent said stripper portion and extending away from the conveying means for engaging the base of the marker and guiding the marker in a predetermined orientation away from the conveying means.

39. A mobile apparatus according to claim 38, wherein the guide portion is adjacent the lower portion of the conveying means and extends along a portion of the highway to stand the marker on its base.

40. A mobile apparatus according to claim 38, wherein the guide portion is adjacent the upper portion of the conveying means and extends obliquely of the direction of travel along the highway.

41. A mobile apparatus according to claim 39, wherein the conveying means comprises loading means orienting and guiding such markers to the conveying means to orient the markers in upright position adjacent said stripper portion.

* * * * *

UNITED STATES PATENT AND TRADEMARK OFFICE

CERTIFICATE OF CORRECTION

PATENT NO. : 5,054,648

DATED : October 8, 1991

INVENTOR(S) : Eugene H. Luoma

It is certified that error appears in the above-identified patent and that said Letters Patent is hereby corrected as shown below:

In claim 14, column 10, line 30, delete "ground" and substitute --highway--.

Signed and Sealed this

Twenty-first Day of September, 1993

Bruce Lehman

*Attest:*

BRUCE LEHMAN

*Attesting Officer*

*Commissioner of Patents and Trademarks*